US009429372B2

(12) United States Patent
Hirsch et al.

(10) Patent No.: US 9,429,372 B2
(45) Date of Patent: Aug. 30, 2016

(54) ACCUMULATOR FOR A COOLING FLUID AND HEAT EXCHANGER

(75) Inventors: Stefan Hirsch, Stuttgart (DE); Heiko Neff, Auenwald (DE); Achim Wiebelt, Deidesheim (DE)

(73) Assignee: MAHLE International GmbH, Stuttgart (DE)

( * ) Notice: Subject to any disclaimer, the term of this patent is extended or adjusted under 35 U.S.C. 154(b) by 233 days.

(21) Appl. No.: 13/548,771

(22) Filed: Jul. 13, 2012

(65) Prior Publication Data

US 2013/0014915 A1 Jan. 17, 2013

(30) Foreign Application Priority Data

Jul. 13, 2011 (DE) ..... 10 2011 079 091

(51) Int. Cl.
*F28F 9/02* (2006.01)

(52) U.S. Cl.
CPC ..... *F28F 9/02* (2013.01); *F28F 9/0209* (2013.01); *F28F 9/0212* (2013.01); *F28F 9/0224* (2013.01)

(58) Field of Classification Search
CPC ..... F28F 9/0224; F28F 9/0212
USPC ..... 165/173–176
See application file for complete search history.

(56) References Cited

U.S. PATENT DOCUMENTS

| | | | | |
|---|---|---|---|---|
| 6,449,979 | B1 * | 9/2002 | Nagasawa et al. | 62/503 |
| 7,275,394 | B2 * | 10/2007 | Lundberg | 62/515 |
| 7,654,108 | B2 * | 2/2010 | Ishizaka et al. | 62/500 |
| 2001/0030043 | A1 * | 10/2001 | Gleisle et al. | 165/167 |
| 2003/0070796 | A1 * | 4/2003 | Berning | 165/173 |
| 2004/0159121 | A1 * | 8/2004 | Horiuchi et al. | 62/526 |
| 2004/0238162 | A1 * | 12/2004 | Seiler et al. | 165/148 |
| 2004/0244956 | A1 * | 12/2004 | Avequin et al. | 165/173 |
| 2007/0163766 | A1 | 7/2007 | Fischer et al. | |
| 2010/0186934 | A1 * | 7/2010 | Bellenfant et al. | 165/164 |

FOREIGN PATENT DOCUMENTS

| | | |
|---|---|---|
| DE | 955 688 | 1/1957 |
| DE | 59 575 A1 | 1/1968 |
| DE | 296 11 633 U1 | 12/1997 |
| FR | 2 504 667 | 10/1982 |
| GB | 559107 | 2/1946 |
| WO | WO 2004/076930 A2 | 9/2004 |

* cited by examiner

*Primary Examiner* — M. Alexandra Elve
*Assistant Examiner* — Joel Attey
(74) *Attorney, Agent, or Firm* — Muncy, Geissler, Olds & Lowe, P.C.

(57) ABSTRACT

An accumulator for a cooling fluid is provided that includes a floor. The floor has an interface for connecting a chamber of the accumulator to at least one cooling tube. The floor also has an opening that extends at least over a partial area of the chamber. The accumulator furthermore has a lid that is embodied in such a way as to seal the opening of the floor in a fluid-tight manner. The lid is embodied as wire or extrusion profile.

15 Claims, 8 Drawing Sheets

ACCUMULATOR FOR A COOLING FLUID AND HEAT EXCHANGER

This nonprovisional application claims priority under 35 U.S.C. §119(a) to German Patent Application No. DE 10 2011 079 091.8, which was filed in Germany on Jul. 13, 2011, and which is herein incorporated by reference.

BACKGROUND OF THE INVENTION

1. Field of the Invention

The present invention relates to an accumulator for a cooling fluid as well as to a heat exchanger.

2. Description of the Background Art

In modern heat exchanger applications, in particular for heat exchangers for hybrid- and electric vehicle accumulator systems, ever greater demands are made with respect to weight, costs and construction space. This requires new variants in these fields of application in both the design and the production of heat exchangers, which variants meet these demands. Up to now cooling plates in a layer sheet metal construction, also other constructions such as two-layer cooling plates or modular tube cooling plates have been usual. Depending on the design, the heat exchanger constructions described offer various advantages. However, the design of a U flow field is only possible with a relatively large expenditure with respect to manufacture or assembly.

SUMMARY OF THE INVENTION

It is therefore an object of the present invention is to provide an improved accumulator for a cooling fluid and an improved heat exchanger.

The present invention is based on the discovery that a separating wall for separating an accumulation area from a distributor area in an accumulator can be a constituent of a sealing component, with which the accumulator can be sealed in a fluid-tight manner. By displacing the separating wall from a base body of the accumulator into a lid of the accumulator, both components can be produced by bending or stamping/bending in only one bending direction respectively.

Advantageously the accumulator can be produced with simple means of production and few manufacturing steps in a cost-effective and rapid manner. This results in a reduction of design-, manufacture-, and assembly expenditure. Moreover this results in a lower weight and less manufacturing waste.

In this manner the construction for example of a modular tube heat exchanger is considerably facilitated in particular with respect to the implementation of a U flow field.

The present invention creates an accumulator for a cooling fluid, having: a floor with an interface for connecting a chamber of the accumulator to at least one cooling tube as well as to an opening that extends at least over a partial area of the chamber; and a lid that is embodied in order to seal the opening of the floor in a fluid-tight manner, wherein the lid is embodied as wire or extrusion profile.

The accumulator can be used in conjunction with a heat exchanger in which a cooling fluid is introduced into the accumulator through a first connection, is guided from the accumulator through the at least one cooling tube to a diverter accumulator, is guided back from the diverter accumulator to the accumulator through at least one second cooling tube and is guided out of the accumulator through a second connection. The accumulator can be designed as a water tank. Thus the accumulator can be understood to mean a device for the distribution of a fluid stream to the at least one first cooling tube and for the accumulation of the fluid stream from the at least one second cooling tube. The accumulator can be composed of the floor and the lid. The chamber can be designed in a fluid-tight manner with respect to the surroundings of the accumulator. The chamber can have the first connection for connecting the chamber to a first hose as an inflow for the cooling fluid.

An interface can be understood to mean one or more apertures through a wall of the accumulator. The apertures can be arranged at least for the most part in a wall of the floor. The interface can be embodied in such a way as to accommodate at least one cooling tube. By means of a soldered connection, cooling tubes can be connected to the accumulator at corresponding interfaces. An interface can be embodied in such a way as to accommodate flat tubes as cooling tubes, which can be fixed by means of a soldered connection. The floor can be embodied as a stamping/bending part. The floor can be bent so that it has a U shape. The opening can run between the end area of the arms of the floor formed in this manner. The lid can be a bending part. The extrusion profile can be a hollow profile. A wire or an extrusion profile can be bent in a particularly simple manner and can be produced in various lengths for various embodiments. Any desired shapes can be produced in a cost-effective manner with a wire bending machine.

The floor can have a further interface for connecting a further chamber of the accumulator to at least one further cooling tube. The opening can extend further over at least a partial area of the further chamber. Thus the accumulator can have at least one first and one further chamber, which are embodied in a fluid-tight manner with respect to the surroundings. The further chamber can have the second connection for connecting the further chamber to a second hose as a drain for the cooling fluid. The interface and the further interface can be arranged adjacent to one another on one side of the floor.

The lid can have a projection that is embodied in such a way as to separate the chamber from the further chamber in a fluid-tight manner. Thus the projection can extend starting from the opening along a separating line between the chambers into an inner chamber of the accumulator.

The projection can be a U-shaped section of the lid. The U-shaped section can be arranged approximately in the middle of the lid. The U-shaped section can provide two sealing points for separating the first chamber from the second chamber. In order to produce the U-shaped section, the lid can be bent in a plane.

The floor can have an aperture that is arranged between the first interface and the further interface. The projection of the lid can be embodied in such a way as to engage in the aperture of the floor. The aperture can be shaped in accordance with the apertures of the interfaces. A uniform tool for the production can be used thereby. If the projection of the lid engages in the aperture, the lid can be secured against slipping.

Alternatively the floor can have a contact area between the interface and the further interface and the projection of the lid can be embodied in such a way as to bear against the contact area in a fluid-tight manner. Without an aperture, the floor can be embodied in a more stable and compact manner.

The opening of the floor can run at least along one side of the floor. The side of the floor of the first interface can be arranged additionally or alternatively with respect to the second interface. The opening can be made by a bending process of the floor and can be sealed by the lid. The opening can also run on three sides of the floor. Then the floor can be produced in a particularly simple manner. In this case the lid can surround the three sides of the floor. The interfaces can be arranged in the bend of the U. If the opening only runs with respect to the interfaces, the lateral edges can be sealed for example by tilting.

The floor can have at least one groove that is embodied in such a way as to guide an end section of the lid. A groove can be understood to mean a recess in the floor that has a part of the cross-section of the lid as a contour component. By these means the lid can be placed in a particularly simple manner with respect to the floor. The groove can be oriented to the interfaces in a line. The end section of the lid can protrude beyond the floor.

The floor can have two diametrically opposed sealing areas that extend along a length of the lid and are embodied in such a way as to bear against opposite sides of the floor. A sealing area can be understood for example to mean a flattening of a round or oval cross-section of the lid, in order to achieve a flat contact between the lid and the floor.

The floor can be connected to the lid via a soldered connection. A durable tight connection of the two components can be achieved thereby.

The present invention also provides in an embodiment a heat exchanger having: an accumulator according to the approach presented here; at least one cooling tube, which is connected to the chamber of the accumulator via the interface of the accumulator; and a diverter tank that has a chamber that is connected to the at least one cooling tube via an interface.

The components of the heat exchanger can be connected to one another via soldered connections. The diverter tank can be designed like the accumulator, but unlike the accumulator without the projection on the lid. The cooling tubes can be connected by means of a heat deflecting plate, in order to create a flat bearing area in the extension of a bearing area of the accumulator and of the diverter tank. According to one form of embodiment the accumulator can have at least one further cooling tube that is connected to a further chamber of the accumulator via a further interface of the accumulator. The chamber of the diverter tank can be connected to the at least one further cooling tube via a further interface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

In the following description of the preferred exemplary embodiments of the present invention, the same or similar reference numbers are used for the elements shown in the various drawings and acting in a similar manner, wherein a repeated description of these elements is omitted.

Figure 1:
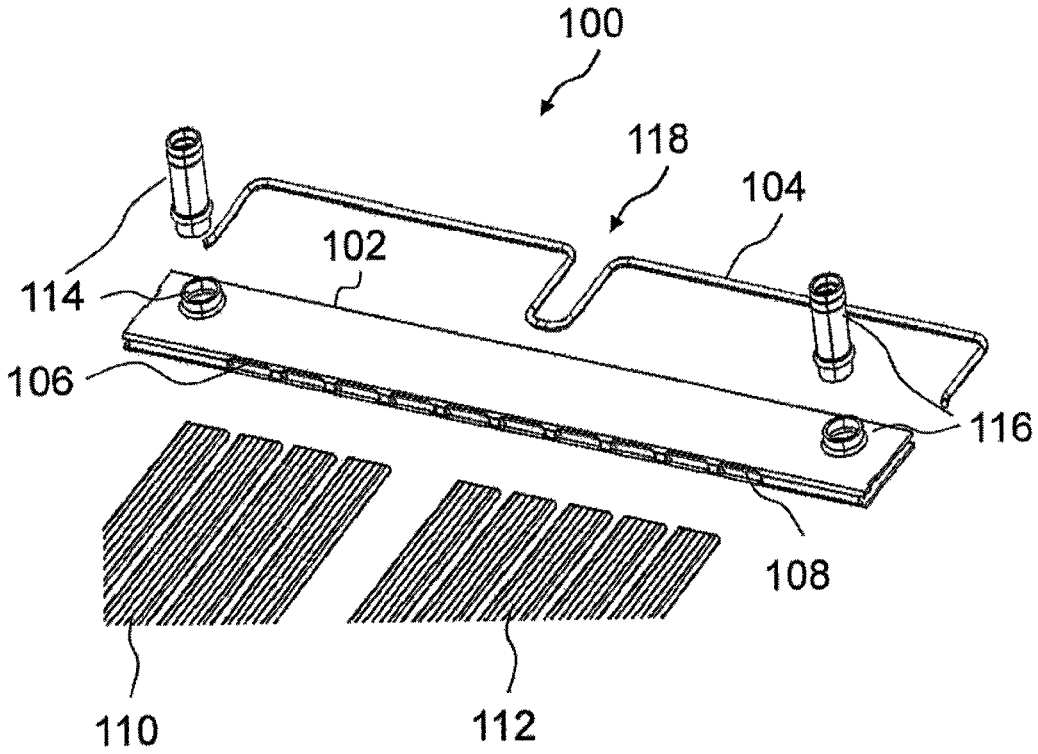
FIG. 1 is an exploded view of a heat exchanger according to an exemplary embodiment of the present invention.

FIG. 1 shows an exploded view of a heat exchanger 100 according to an exemplary embodiment of the present invention. Components of an accumulator of the heat exchanger 100 and components of a cooling area of the heat exchanger 100 are shown. The accumulator has a floor 102 and a lid 104.

The floor 102 is embodied as a stamping/bending part made of plate material. It has a U-shaped contour. A first arm of the U-shaped floor 102 is oriented parallel to a second equally long arm of the U-shaped floor 102. A first interface 106 and a second interface 108 are arranged along a bending edge of the floor 102, at which the first arm of the floor 102 is connected to the second arm of the floor 102. The interfaces are oriented along a line. A width of the floor 102 beyond the bending edge is considerably smaller than a height of the floor 102 along the arm of the floor. The height of the floor 102 is considerably smaller than a length of the floor 102 along the bending edge.

The first interface 106 is embodied in such a way as to connect a first chamber of the accumulator to first cooling tubes 110 of the cooling area. The second interface 108 is embodied in such a way as to connect a second chamber of the accumulator with second cooling tubes 112 of the cooling area. The cooling tubes 110, 112 of the cooling area are embodied as flat tubes. In this exemplary embodiment four flat tubes are shown as first cooling tubes 110 and five flat tubes are shown as second cooling tubes 112. The interfaces 106, 108 are embodied as long narrow apertures through the bending edge of the floor 102. The apertures have identical dimensions and are arranged at regular intervals along the bending edge. A first hose connection 114 and a second hose connection 116 are arranged on the first arm of the U-shaped floor 102. The first hose connection 114 is embodied in such a way as to connect the first chamber of the accumulator to a first hose or tube. The second hose connection 116 is embodied in such a way as to connect the second chamber of the accumulator to a second hose or tube.

The lid 104 is embodied as a bent wire or as a bent hollow wire with rounded cross-section. The lid 104 is bent multiple times in a rectangular manner in a plane. At the bending points the lid 104 has bending radii. The lid 104 is bent in such a way that the lid 104 can seal the three open sides of the floor 102, which are formed by edge sections of the arm areas of the floor 102. The lid 104 is embodied in such a way as to be accommodated between the first arm and the second arm of the floor 102. A U-shaped projection 118 is arranged centrally in the lid 104. The projection 118 is embodied in such a way as to separate the fluid of the first chamber of the floor 102 from the fluid of the second chamber of the floor 102. For this purpose the projection is embodied in such a way as to be introduced between the first arm and the second arm of the floor, and to be inserted through an aperture in the bending edge of the floor 102.

Figure 7:
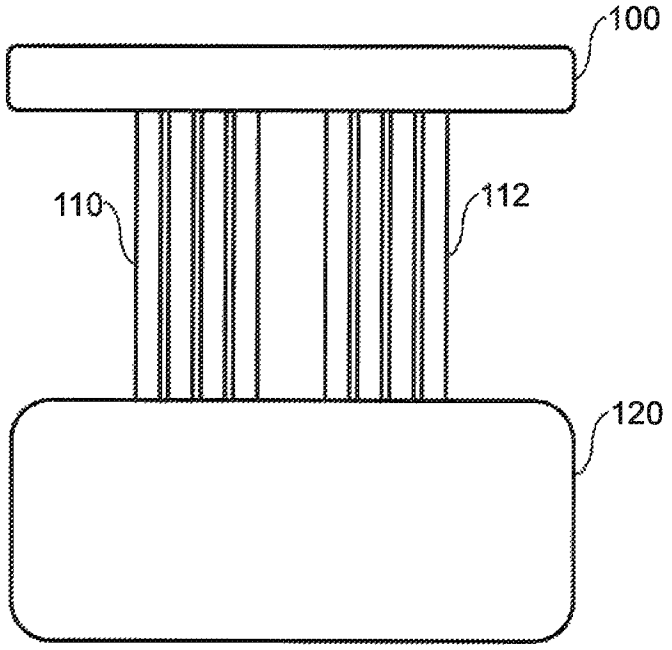
FIG. 7 is a block diagram of a heat exchanger and a diverter tank according to an exemplary embodiment of the present embodiment.

The heat exchanger 100 in the assembled state is embodied in such a way as to conduct a cooling fluid from the first hose connection 114 into the first chamber of the accumulator 200 and through the first cooling tubes 110 to a diverter tank, 120 as shown in FIG. 7. Moreover the heat exchanger 100 in the assembled state is embodied in such a way as to conduct the cooling fluid from the diverter tank through the second cooling tubes 112 into the second chamber and through the second hose connection 116 out of the heat exchanger 100.

Figure 2A:
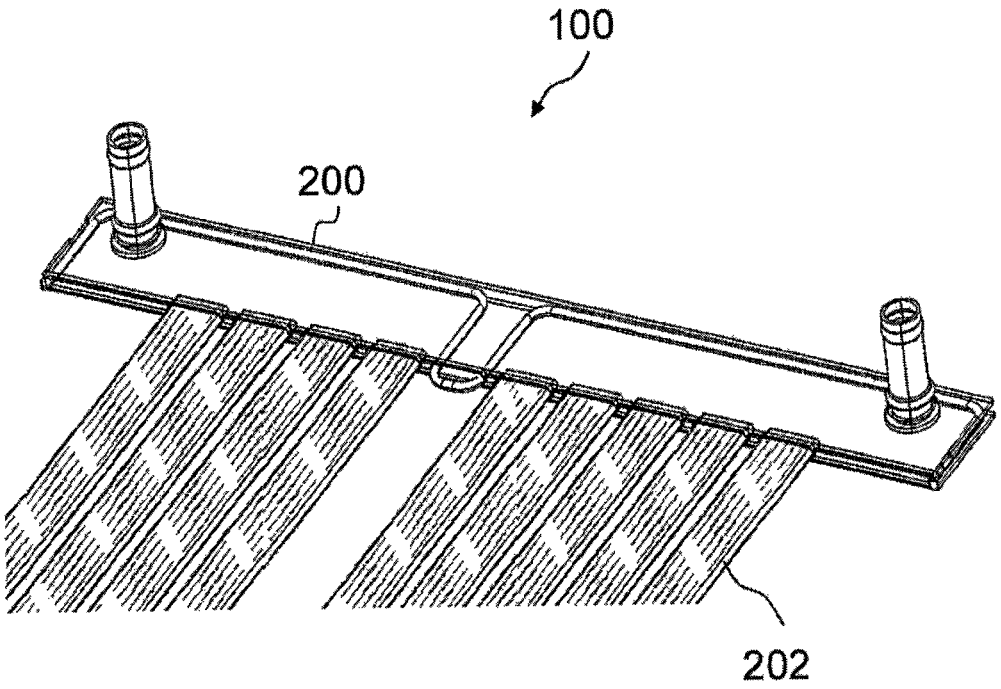
FIG. 2*a* is a view of a heat exchanger according to an exemplary embodiment of the present invention.

FIG. 2*a* shows a transparent view of an assembled heat exchanger 100 according to an exemplary embodiment of the present invention. The heat exchanger can be the heat exchanger described based on FIG. 1. The heat exchanger 100 is manufactured based on a manufacturing design according to the invention for the production of fluid accumulators for heat exchangers. A section of the heat exchanger 100 with an accumulator 200 and a part of a cooling area 202 is shown.

The accumulator 200 is composed of a floor and a lid, as described in FIG. 1. The lid is arranged between the arm areas of the floor and seals the accumulator 200 on three sides in a fluid-tight manner. The projection of the lid Is inserted through an aperture in the bending edge of the floor and projects from the floor. The projection divides the accumulator 200 into the first chamber and the second chamber thereby. The first chamber is connected to the first cooling pipes. The second chamber is connected to the second cooling pipes. Contact points between the floor and the lid can be continuously connected together by adhesive force, for example via a soldered connection.

According to an exemplary embodiment, the heat exchanger 100 is constructed using the modular tube method. This offers a high degree of modularization due to the use of individual extruded flat tubes. The width and length of the desired cooling area 202 can be implemented at relatively low expenditure. The accumulator areas for the heat exchanger fluid are formed thereby via bent sheet metal, into which the flat tubes are pushed. The additional lid thereby forms the necessary sealed accumulator volumes for the fluid. In applications with a U-shaped flow design, due to the necessary separation of the flow path in one of the accumulator areas an additional manufacture and assembly expenditure ensues caused by a separating wall in the area of the fluid accumulator 200. According to this exemplary embodiment the additional expenditure is avoided by integrating a separating wall into the lid of the accumulator area, in the form of the projection of the lid. In the simplest case, the lid can be embodied as a bent element with a round or rectangular cross-section. The production of the respectively required geometry can be embodied by a wire semi-finished product or an extruded profile, which is brought into the desired shape by means of a suitable production device or a bending machine. In this manner it is possible to realize one or more volumes separated from one another within the accumulator 200 by means of a component.

Figure 2B:
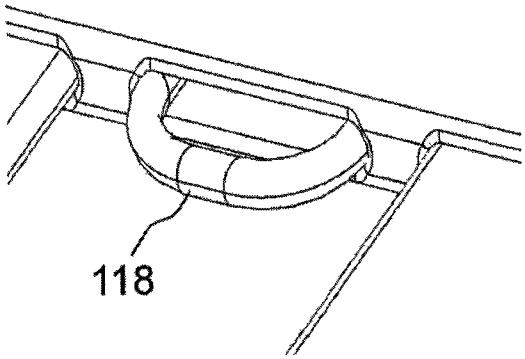
FIG. 2*b* is a detail view of a projection of a lid of a heat exchanger according to an exemplary embodiment of the present invention.
Figure 2C:
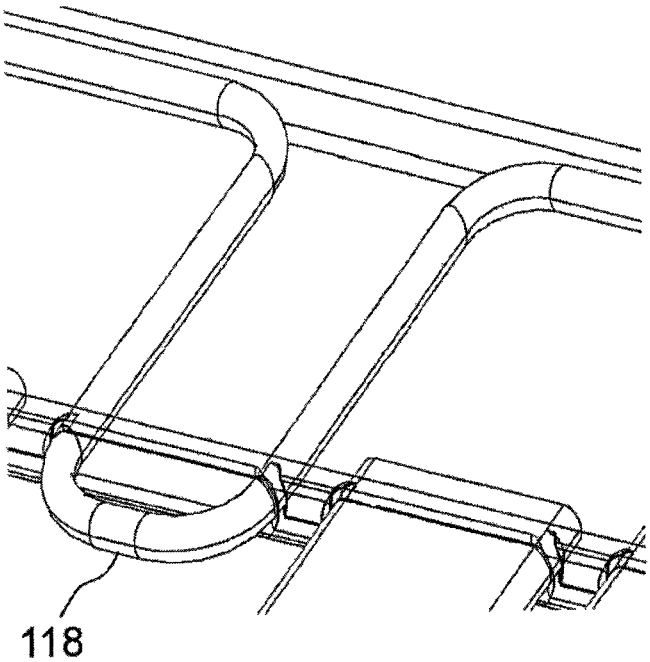
FIG. 2*c* is a detail view of the projection according to an exemplary embodiment of the present invention.

FIGS. 2*b* and 2*c* show a detail of the heat exchanger from FIG. 2*a*. The U-shaped projection 118, a bent tab in the lid, is pushed into an empty flat tube passage of the floor as a separating wall. In FIG. 2*b* only visible edges are shown. A bent end section of the U-shaped projection 118, which projects from the empty flat tube passage, is shown. In this context, empty means that the empty flat tube passage has not received a flat tube. In the contact area between the projection 118 and the flat tube passage, a contour of the wall of the flat tube passage is adjusted to a contour of an outer area of the projection 118, so that inner areas of the chambers of the accumulator are sealed in a fluid-tight manner from the empty flat tube passage by means of the projection 118. In FIG. 2*c* non-visible edges of the projection 118 are also shown. By these means the separation of the first chamber of the accumulator from the second chamber of the accumulator can be recognized by two sealing edges along a contact line of the projection 118 with the floor. A width of the projection 118 corresponds to a width of the empty flat tube passage. A height of the projection 118 and also of the lid corresponds to a height of the empty flat tube passage as well as a space between the opposite walls of the accumulator.

Figure 3:
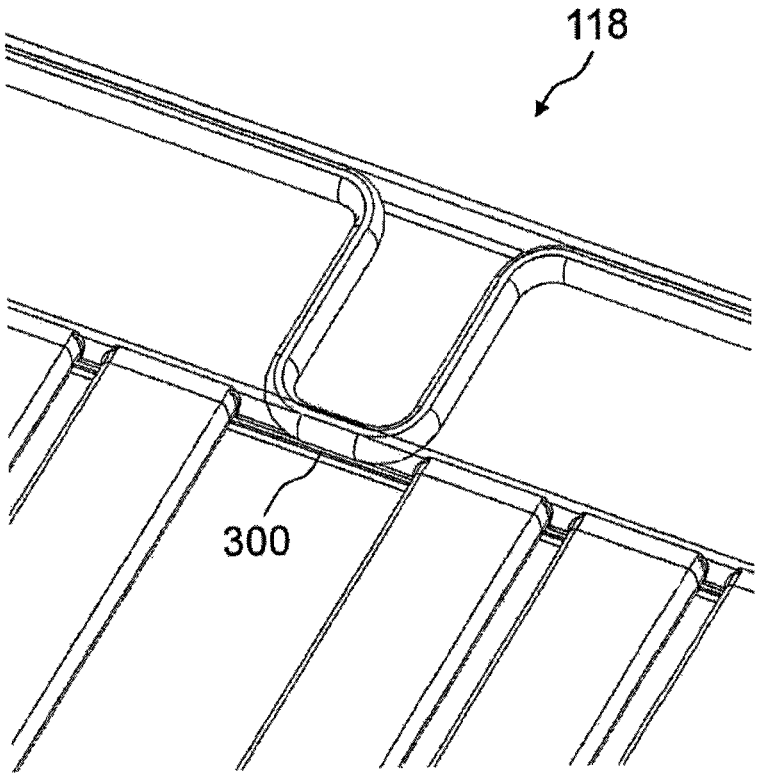
FIG. 3 is a view of a further exemplary embodiment of a projection of a heat exchanger according to the present invention.

FIG. 3 shows a heat exchanger according to a further exemplary embodiment of the present invention. The exemplary embodiment shown in FIG. 3 differs from the exemplary embodiments shown in FIGS. 1 to 2 in the shape of the projection 118. The projection 118 is embodied shorter than in the exemplary embodiment shown in FIG. 2. The floor has no aperture for the projection 118. Instead of this, the floor has a contact point 300, against which an end section of the projection 118 bears, in order to separate the first chamber from the second chamber. The projection 118 is embodied as a bent tab 118 of the lid and serves as a separating wall between the chambers of the accumulator. The bent tab 118 is soldered to the floor in the face area at the contact point 300.

Figure 4:
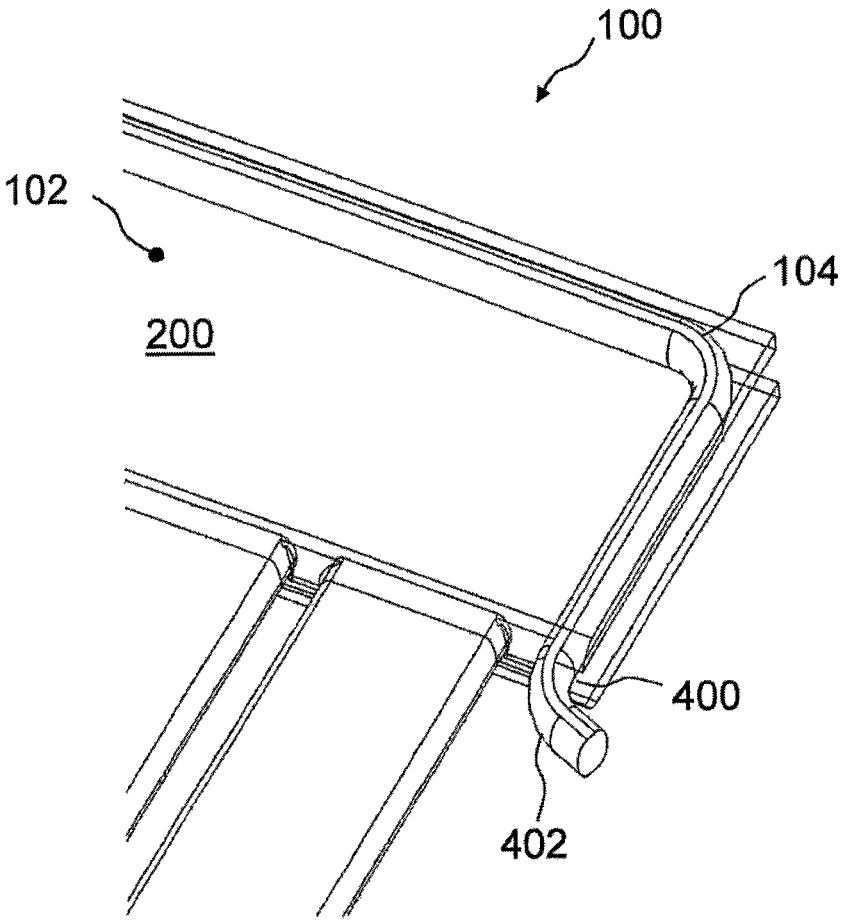
FIG. 4 is a view of a heat exchanger according to a further exemplary embodiment of the present invention.

FIG. 4 shows a detail of the heat exchanger 100 from FIG. 2 or FIG. 3. A lateral separation of the accumulating area 200 is shown. The bent U-shaped floor 102 made of sheet metal is sealed on three sides by the wire-form lid 104. The floor 102 has a groove 400 in the bending edge at a narrow side. The lid 104 is guided over the lateral notch 400 in the floor 102. The lid 104 has in the end area a displayed section 402 as an insertion slope, in order to enable easier insertion into the groove 400. The lid 104 is flattened on the two sides facing the floor 102, in order to achieve an enlarged contact area.

Figure 5:
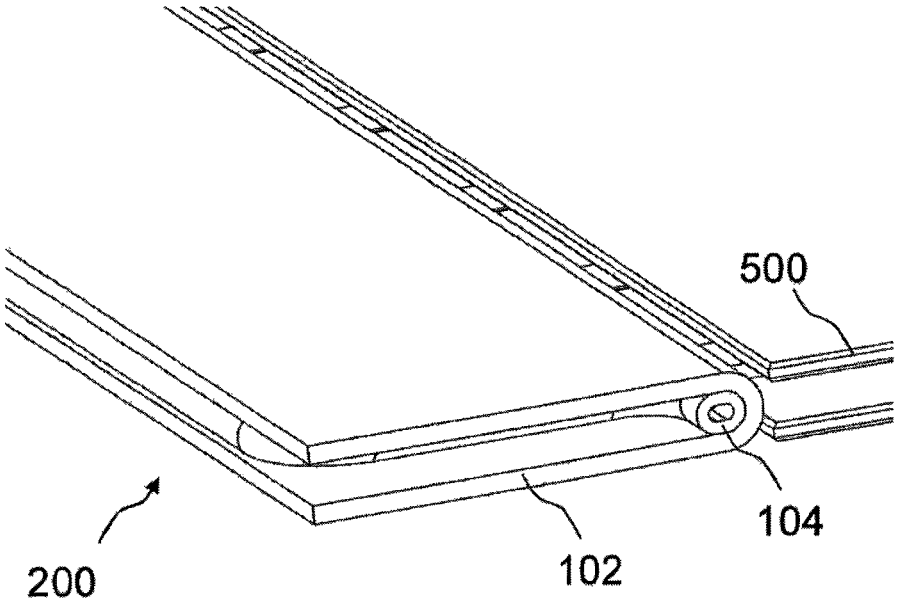
FIG. 5 is a sectional view through an accumulator of a heat exchanger according to an exemplary embodiment of the present invention.

FIG. 5 shows an accumulator 200 according to a further exemplary embodiment of the present invention. In contrast to the accumulator shown in FIG. 4, the accumulator does not have a groove at the lateral end of the accumulator 200. In order to achieve a reliable sealing, the lid 104 is bent in the end area parallel to the bending edge of the floor 102 and bears flat against an inner radius of the bending edge. The lid 104 is embodied as a hollow wire or flattened tube. The cooling area of the heat exchanger is provided on both sides with respectively one cover sheet 500. The heat exchanger thereby has a uniform thickness continuously.

Figure 6:
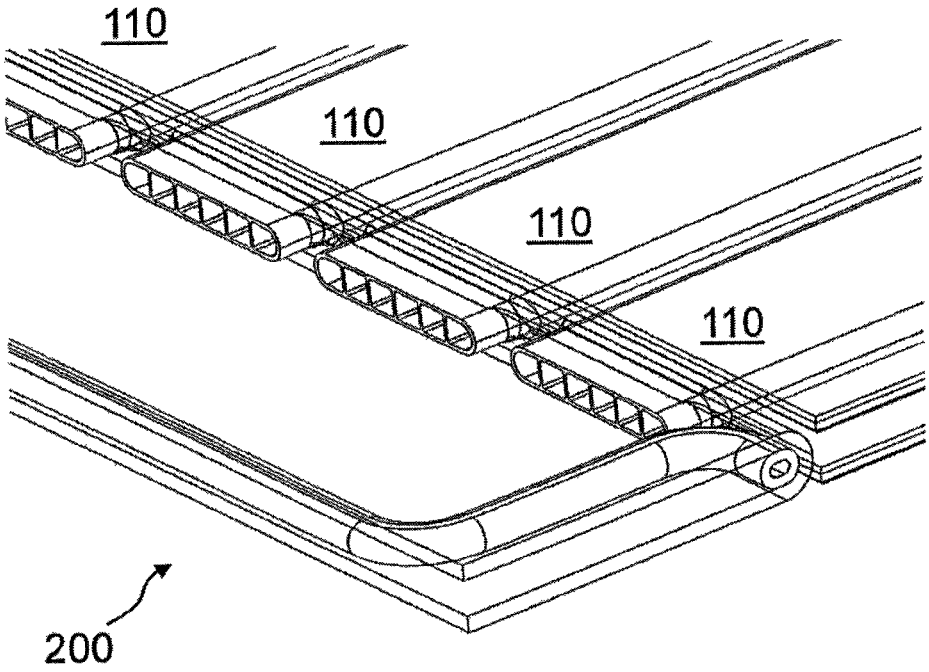
FIG. 6 is a further view of a heat exchanger according to an exemplary embodiment of the present invention.

FIG. 6 shows the representation of the accumulator 200 from FIG. 5 in a transparent view. One of the interfaces is additionally shown here. Four flat tubes 110 with inner ribs are inserted through long narrow holes along the bending edge and are connected to the accumulator 200 in a fluid-tight manner.

The present description and illustration of the pointer to the solution represents only one possibility for the implementation. Various accumulator forms and accumulator design possibilities can moreover be taken into consideration. For example, the embodiment of the lid as well as the integration of one or more separating walls in the lid are possible by various means. Moreover the cross-section of the lid can have any desired profile.

The described exemplary embodiments are only selected by way of example and can be combined with one another.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An accumulator for a cooling fluid, the accumulator comprising:

a floor having a length and a width that is perpendicular to the length, the width being shorter than the length, the floor having a first side and a second side extending in a length direction of the floor, the first side being on an opposite side from the second side, the floor having an interface on the first side for connecting a chamber of the accumulator to a plurality of cooling tubes and to an opening on the second side wall that extends at least over a partial area of the chamber, the interface including at least two first interfaces and at least two second interfaces that are disposed along a same linear plane in the length direction of the floor; and a lid that is configured to seal the opening on the second side of the floor in a fluid-tight manner, the lid having straight sections, a projection and two diametrically opposed sealing sections, the straight sections extending in a length direction of the floor, the projection being integrally connected to and disposed between the straight sections and extending from the second side through the first side of the floor in a width direction of the floor and between the at least two first interfaces and the at least two second interfaces, the two diametrically opposed sealing sections extending from opposite ends of the straight sections in the width direction of the floor, each diametrically opposed sealing section having a first bent section that bends the end of the corresponding straight section in the width direction of the floor and a second bent section that bends the end of the corresponding straight section in the length direction of the floor, the ends of the straight sections extending from the respective second bent section in a direction opposite from each other, wherein the floor has at least one groove that is configured to guide the first and second bend sections of the lid, wherein the projection includes a pair of straight parts that extends from the second side through the first side of the floor in a width direction of the floor, the straight parts are parallel to each other with a space therebetween, a plane that extends through the straight parts of the projection extends parallel to the linear plane of the floor, and the straight sections of the lid are spaced away by the space.

2. The accumulator according to claim 1, wherein the floor has a further interface for connecting a further chamber of the accumulator to at least one further cooling tube, and wherein the opening extends over at least a partial area of the further chamber.

3. The accumulator according to claim 2, wherein the projection separates the chamber from the further chamber in a fluid-tight manner.

4. The accumulator according to claim 3, wherein the floor has an aperture that is arranged between the interface and a further interface, and wherein the projection of the lid is configured to engage with the aperture of the floor.

5. The accumulator according to claim 3, wherein the floor has a contact area between the interface and the further interface, and wherein the projection of the lid is configured to bear against the contact area in a fluid-tight manner.

6. The accumulator according to claim 1, wherein the opening of the floor runs at least along the second side of the floor, which side is arranged opposite the interface and/or a further interface.

7. The accumulator according to claim 1, wherein the floor is connectable to the lid via a soldered connection.

8. The accumulator according to claim 1, wherein the projection has a bottom section that forms a U-shape with the straight parts of the protrusion.

9. The accumulator according to claim 8, wherein a plane connecting the two straight portions are parallel with the plane in which the at least two first interface and the at least two second interface are disposed.

10. The accumulator according to claim 1, wherein the lid has a circumference with a continuous rounded cross-section.

11. The accumulator according to claim 10, wherein the rounded cross-section of the lid includes a hollow section that is entirely enclosed by the rounded cross-section.

12. The accumulator according to claim 1, wherein each of the at least two first interfaces and each of the at least two second interfaces have a flat oval shape with two parallel straight portions that extend in the length direction of the floor.

13. The accumulator according to claim 1, wherein the second bent section perpendicularly bends the end of the corresponding straight section.

14. A heat exchanger comprising:

an accumulator according to claim 1;

the plurality of cooling tubes that are connectable to the chamber of the accumulator via the interface of the accumulator; and a diverter tank that has a chamber that is connectable to the plurality of cooling tubes via the interface.

15. The heat exchanger of claim 14, wherein each of the plurality of cooling tubes flats surfaces that oppose each other and are in parallel with a length-width plane of the floor when inserted into the interface of the accumulator.

* * * * *